United States Patent [19]

Ruehl et al.

[11] Patent Number: 4,780,362

[45] Date of Patent: Oct. 25, 1988

[54] BITUMINOUS ROOFING STRIP

[75] Inventors: Karl Ruehl, Bad Nauheim; Ernst Scherp, Bruchkoebel, both of Fed. Rep. of Germany

[73] Assignee: Rütgerswerke Aktiengesellschaft, Frankfurt am Main, Fed. Rep. of Germany

[21] Appl. No.: 100,386

[22] Filed: Sep. 24, 1987

[30] Foreign Application Priority Data

Oct. 3, 1986 [DE] Fed. Rep. of Germany ..... 3633647

[51] Int. Cl.[4] ..... B05D 3/06; B32B 7/10; B32B 11/00; C09J 7/02; D06N 7/04

[52] U.S. Cl. ..... 428/291; 427/44; 428/349; 428/354; 428/440; 428/489

[58] Field of Search ..... 427/44; 428/440, 489, 428/354, 349, 291

[56] References Cited

U.S. PATENT DOCUMENTS

| | | | |
|---|---|---|---|
| 4,210,693 | 7/1980 | Regan et al. | 427/44 |
| 4,333,866 | 6/1982 | Uffner | 428/440 |
| 4,405,689 | 9/1983 | Watanabe | 428/440 |
| 4,413,019 | 11/1983 | Brenner | 427/44 |
| 4,420,524 | 12/1983 | Georgati | 428/291 |
| 4,440,816 | 4/1984 | Uffner | 428/291 |
| 4,528,241 | 7/1985 | Uffner et al. | 428/291 |
| 4,530,652 | 7/1985 | Buck et al. | 428/291 |
| 4,600,635 | 7/1986 | Wrercinski et al. | 428/489 |
| 4,714,651 | 12/1987 | Hartmann et al. | 428/291 |

FOREIGN PATENT DOCUMENTS

| | | | |
|---|---|---|---|
| 221002 | 4/1985 | German Democratic Rep. | . |
| 129263 | 11/1978 | Japan | 428/440 |

*Primary Examiner*—James C. Cannon

*Attorney, Agent, or Firm*—Beveridge, DeGrandi & Weilacher

[57] ABSTRACT

A roofing strip with a very wide range of plasticity and based on elastomer-modified bitumen is prepared by covering a support with a bitumen/rubber mixture in the ratio of 17/3–19/1 and irradiating the strip at a rate between 6 and $16 \times 10^4$ Gy.

8 Claims, No Drawings

BITUMINOUS ROOFING STRIP

The present invention relates to a polymer-modified bituminous roofing strip.

BACKGROUND OF THE INVENTION

Bituminous strips for roof covering material are typically formed of a support such as foil, fabric or non-woven material (or web), which support can optionally be bitumen-impregnated, and which support is further coated at least on one side with a bituminous covering. The surface of the bituminous covering is provided with a conventional separating means for the purpose of preventing the strip from bonding to itself when being in a coiled-up condition. The separating means can also fulfill further functions such as providing ultra-violet protection at the uppermost layer of the roofing material.

To improve their mechanical properties, the bituminous covering materials of the past have been modified with bitumen-compatible/polymers. These polymers increase the range of plasticity of the material and also increase the viscosity of the melt. When rubber and rubber-like polymers are added to such materials, both the softening point is raised and cold flexibility is improved. Furthermore, the elasticity of the bituminous material is improved thereby. Such polymers are usually based on double bond-containing monomers. These double-bond containing polymers, however, suffer from the drawback of low aging resistance to ultraviolet (uv) radiation. It is known to add polylefins such as polyethylene in order to advantageously affect aging behavior, but as a rule no improvement in cold flexibility is achieved, and, moreover, the elasticity is only slightly improved. The plasticity range of known elastomer-modified polymer bitumen is approximately between +125° and −35° C. and as regards the olefin-modified ones, between about +150° and −15° C. The plasticity range therefore is approximately equal but is shifted by about 25° K. This is as important a factor in selecting a roofing strip as its bonding and fusing behavior or the resistance to chemicals and aging.

DD No. 215,559 proposes to improve the dimensional stability of bitumen mixtures even at higher temperatures by adding radiation-crosslinked polymers, in particular polyethylene. The degree of crosslinking should be selected in such a manner that the crosslinked polymer still can adequately dissolve in the bitumen, because highly crosslinked polymers must be considered being fillers capable of only slightly affecting the properties of the bituminous materials. Crosslinking raises the molecular weight of the polymer, which in known manner positively affects the softening point but negatively affects the rupture point and penetration (See STRASSE UND AUTOBAHN 1986, pp 3–9).

The bitumen mixtures of DD No. 215,559 as shown by the description, are meant most of all for road construction. This is also apparent from the bitumen selected in the Examples, where bitumen types B50 and B80 are used, which are unsuitable as roof covering materials.

SUMMARY OF THE INVENTION

An object of the present invention is to provide an aging-resistant roofing strip which can be hot and cold bonded with bituminous bonding materials suitable for roofing purposes and which exhibits a widened range of plasticity, which range includes that of the polyolefin and rubber-modified bitumens.

In attaining this and other objects, a feature of the present residue is a roofing strip comprising a support coated at least on one side with a polymer bitumen covering substance, and wherein the support itself is optionally also impregnated with bitumens. The covering substance according to the present invention contains a mixture of bitumen/rubber with a bitumen to rubber ratio between 17/3 and 19/1 and being radiation-crosslinked following strip manufacture. The bitumen used for purposes of the present invention are those bitumens that are known for roofing covering applications. Bitumen B 200 is one such typical substance and others will be apparent to those skilled in the art.

All natural and synthetic rubbers can be used for purposes of the present invention which are bitumen-compatible and radiation-crosslinkable, for instance styrene-butadiene rubber and polybutadiene. The support materials in accordance with the invention are capable of being coated with the bitumen composition and are the conventional non-woven materials, nettings or fabrics made of glass fibers or temperature-resistant synthetic fibers; further the supports may be foils of metal or of plastic undergraded by crosslinking. Such support layer materials are dimensionally stable under the conditions used. Preferably the fiber strips are made to be capable of being impregnated with bitumen, possibly modified by an electron-beam crosslinked polymer. These support layers are inert to the bitumen and rubbery polymer and are non-reactive under the conditions used in carrying out the invention.

Where the strips are not self-adhesive, the support material is coated on both sides with the crosslinkable covering material. Mineral parting means may be scattered on the surfaces, which also may be laminated with foils in the manner common in roofing strips, depending on application. Any suitable mineral separating means known in the art can be used for this purpose.

Bituminous hot-melt and cold-adhesive layers additionally may be deposited before or after irradiation. However, the underside of the support material also may be directly coated with the bituminous adhesive. Fusing strips of this kind are in fact known from the German OLS No. 30 42 943, but their top cover layer is a vulcanized mixture of rubbers with only a slight amount of bitumin.

DETAILED DESCRIPTION OF THE INVENTION

The invention is illustrated more comprehensively below in relation to the following Examples:

EXAMPLE 1

A polyester non-woven fiber web (230 g/m$^2$) is impregnated in conventional manner used in manufacturing bituminous roofing strips with a mixture of 90 parts by weight of distilled bitumen B 200 and 10 parts by weight of styrenebutadiene rubber and is coated on both sides with a mixture of 63 parts by weight of distilled bitumen B 200, 7 parts by weight of styrene-butadiene rubber and 30 parts by weight of slate dust having grain sizes $100<\mu m$, in a coating thickness of 1 mm on each side. Slate chips ($\leqq 1.5$ mm) are sprayed on the top side and fine sand on the lower side. Thereupon the strip moves through an electron accelerator and is irradiated at $16\times10^4$ Gy. One sample each is taken from the irradiated and non-irradiated material, and tested. Table 1 shows the test results. The plasticity range (temperature range from the cold strength of the strip per DIN 52123 to the softening point [RuK] of the covering material per DIN 52011) has been widened in both directions by the radiation and increased by 70° K. The softening point is above that of conventional olefin-modified substances.

TABLE 1

| | before IRRADIATION | after IRRADIATION |
|---|---|---|
| softening point (RuK) of covering material (°C.) | 120 | 180 |
| strip heat resistance up to (°C.) | 100 | 130 |
| strip cold resistance down to (°C.) | −30 | −40 |

EXAMPLE 2

Example 1 is repeated, the proportion of the styrenebutadiene rubber in the impregnation and covering material being replaced by the same amount of polybutadiene. Table 2 shows the results. The plasticity range is increased by 161° K. and in both directions exceeds the plasticity range of the irradiated strip of Example 1.

TABLE 2

| | before IRRADIATION | after IRRADIATION |
|---|---|---|
| Covering material softening point (RuK) in °C. | 64 | 205 |
| Strip heat resistance up to (°C.) | 40 | 130 |
| Strip cold resistance down to (°C.) | −30 | −50 |

The roofing strips of the invention of Examples 1 and 2 are extraordinarily well suited for bonding using a hot bitumin or a bituminous cold adhesive.

EXAMPLE 3

A roofing strip equipped with cold self-adhesive is prepared from a polyester fiber web (230 g/m$^2$) impregnated with a blown bitumen 85/40, this web being coated at its top side with 1 mm of the covering material corresponding to Example 1 and on the lower side with 1 mm of a substance prepared from 65 parts by weight of distilled bitumin B 200, 11 parts by weight of styrene-butadien-styrol-rubber, 8 parts by weight of colophonium and 3 parts by weight of the naphthenic oil. The top side then is sprayed as in Example 1 and the lower side is covered with siliconized paper. The strip then is irradiated as described in Example 1 with $8\times10^4$ Gy. The adhesion of the lower side remains unaffected. Therefore the cold adhesive remains unchanged when irradiated.

EXAMPLE 4

A hot-melt strip is prepared from a glass fiber web (100 g/m$^2$) which was impregnated as in Example 2 and coated on the top side. The lower side is provided with a 1 mm coat of a blown bitumen 100/30. Thereupon slate chips are sprayed on the top side and the lower side is covered with talc. The strip is irradiated with $6\times10^4$ Gy and can be hot-melted on all conventional substrates like an untreated hot-melt strip. Accordingly, the hot-melt material is unaffected by radiation.

Further variations and modifications of the foregoing will be apparent to those skilled in the art from the foregoing and are intended to be encompassed by the claims appended thereto.

We claim:

1. A roofing strip comprising a support material coated at least on one side with a polymer-bitumin coating material, wherein the covering material contains a mixture of bitumen/rubber in a ratio of bitumen to rubber between 17/3 and 19/1 which has been crosslinked by radiation.

2. The roofing strip defined in claim 1 wherein said support is itself impregnated with bitumen.

3. The roofing strip defined in claim 1, wherein the bituman/rubber mixture contains styrene-butadiene rubber.

4. The roofing strip defined in claim 1, wherein bitumen/rubber mixture contains polybutadiene.

5. The roofing strip defined in claim 1 wherein the strip is irradiated in an electron accelerator at a rate between $6\times10^4$ and $16\times10^4$ Gy.

6. The roofing strip defined in claim 1 wherein the support is a fiberstrip impregnated with a bitumen that was modified by an electron-beam crosslinking polymer.

7. The roofing strip defined in claim 1 wherein th underside of the roofing strip is lined with a bituminous hotmelt adhesive.

8. The roofing strip defined in claim 1 wherein the underside of the strip is lined with a bituminous cold-adhesive.

* * * * *